United States Patent [19]

Ray

[11] 4,049,268

[45] Sept. 20, 1977

[54] RACKET STRING CLAMP

[76] Inventor: Lynn L. Ray, P.O. Box 4034, San Diego, Calif. 92104

[21] Appl. No.: 752,035

[22] Filed: Dec. 20, 1976

[51] Int. Cl.[2] ..... A63B 51/14

[52] U.S. Cl. ..... 273/73 A

[58] Field of Search ..... 273/73 R, 73 A, 73 B; 24/71 CT; 33/143 R, 174 R

[56] References Cited

U.S. PATENT DOCUMENTS

| | | | |
|---|---|---|---|
| 3,635,080 | 1/1972 | Krueger et al. | 273/73 A X |
| 3,994,495 | 11/1976 | Stoffel | 273/73 A X |

FOREIGN PATENT DOCUMENTS

| | | | |
|---|---|---|---|
| 209,777 | 8/1957 | Australia | 273/73 A |
| 855,114 | 2/1940 | France | 273/73 A |
| 446,447 | 4/1936 | United Kingdom | 273/73 A |
| 458,992 | 12/1936 | United Kingdom | 273/73 A |

*Primary Examiner*—Richard J. Apley

*Attorney, Agent, or Firm*—Isbell & Charmasson

[57] ABSTRACT

A hand tool used in the stringing of a tennis racket, for holding the tension of a string by attaching it to an adjacent string, which features a spacer held between two clamping members forming two parallel pinching jaws capable of pinching two adjacent strings in one clamping action.

9 Claims, 6 Drawing Figures

RACKET STRING CLAMP

BACKGROUND OF THE INVENTION

In the stringing of a tennis racket either manually or by means of a stringing machine; clamping devices are used to hold the tension of a string after pulling it between the edges of the racket, while the string is being reinserted and pulled through in the reverse direction. The conventional clamping devices are usually secured to the edges of the racket or to some external support. The installation of such clamping devices and supporting accessories is often awkward and time consuming.

SUMMARY OF THE INVENTION

The present invention provides a hand tool used in the stringing of a tennis racket for holding the tension of a string by attaching it to an adjacent string. The principal object of the invention is to expedite the stringing of a racket by providing a simple tool for quickly and singlehandedly installing a resilient clamp over a string, in order to temporarily hold its tension, while the string is being reinserted across the racket edges.

Another object of the invention is to provide a dual string clamp which can be used on rackets with different string spacings.

A further object of the invention is to provide a string clamping device which is easy to handle and is self-adjusting.

Other objects, and many of the attendant advantages, of the present invention will be readily appreciated as the same becomes better understood by reference to the following detailed description when considered in connection with the accompanying drawing in which like reference numerals designate like parts throughout the Figures.

IN THE DRAWING

DESCRIPTION OF THE PREFERRED EMBODIMENT

Figure 1:
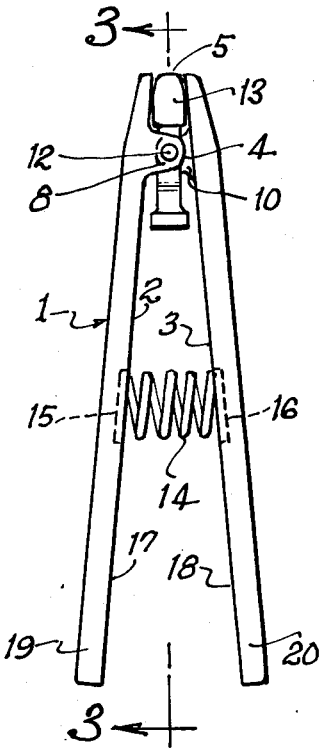
FIG. 1 is a front elevation of the racket string clamp.
Figure 2:
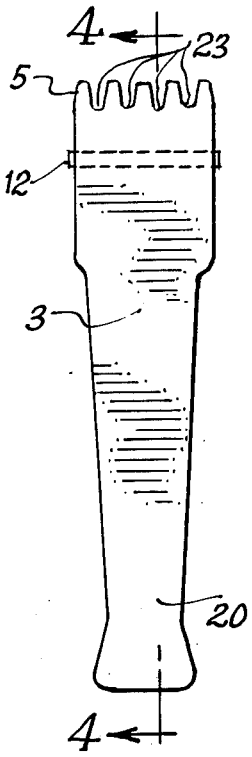
FIG. 2 is a side view thereof.
Figure 3:
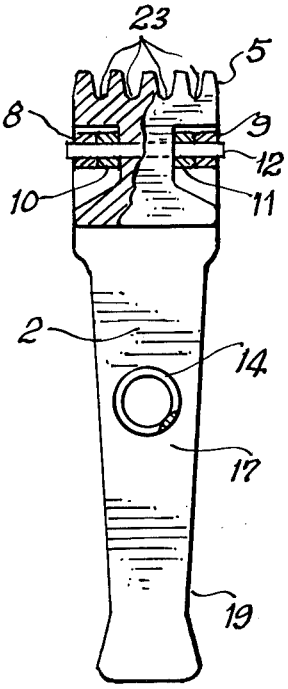
FIG. 3 is a cross-sectional view taken along line 3—3 of FIG. 1.
Figure 4:
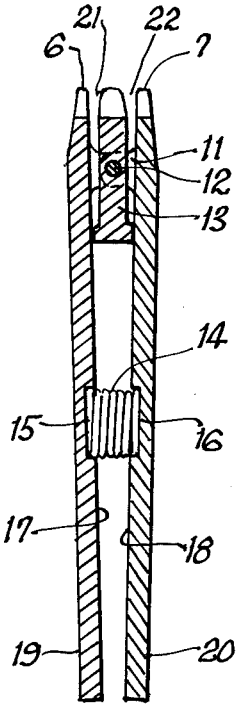
FIG. 4 is a cross-sectional view taken along line 4—4 of FIG. 2.
Figure 5:
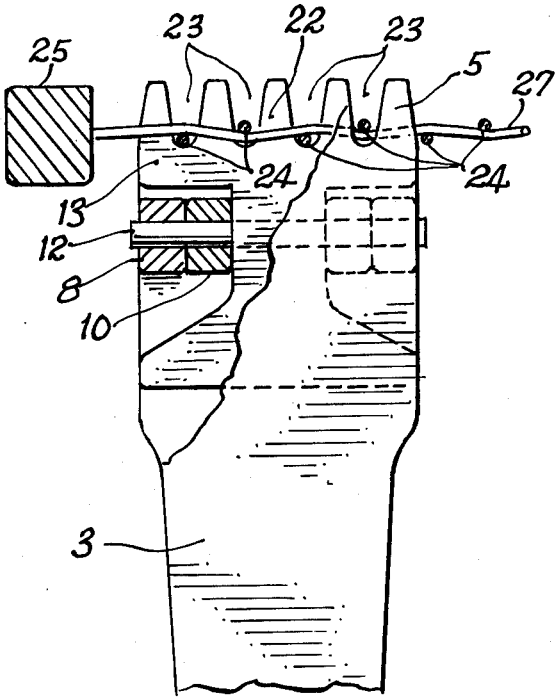
FIG. 5 is a partial cross-sectional view taken along line 5—5 of FIG. 6.
Figure 6:
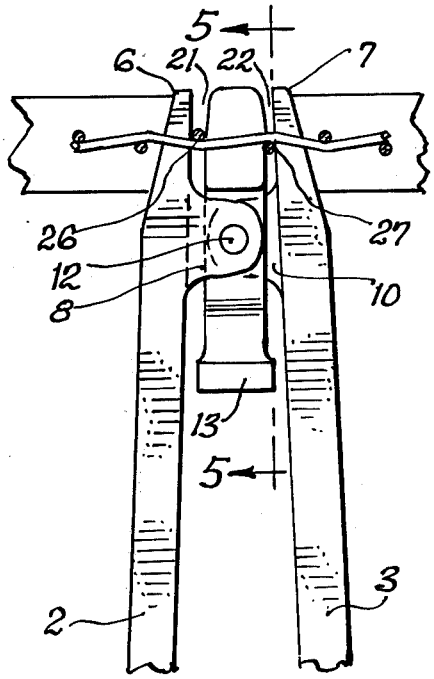
FIG. 6 is a enlarged front view of the clamp installed across two strings in the mesh of a racket.

Referring now to the drawing, there is shown a clamping device 1 used in the stringing of a racket, for holding the tension of a string 27 by attaching it to an adjacent string 26. A section 25 of the racket frame is shown in FIGS. 5 and 6.

The clamping device comprises two substantially flat levers 2, 3 transversally linked by means of a hinge 4. The hinge 4 is located near one end 5 of the levers so as to permit a rocking motion of each lever against the other. Said end 5 of the levers form a set of clamping jaws 6, 7.

The hinge 4 is formed by two hollowed projections 8, 9, 10, 11 on the inside surface 17, 18 of each lever and a pin 12 transversally inserted through said projections. The hollowed projections 10, 11 of one lever 3 are dimensioned and spaced apart so as to rest between the hollowed projections 8, 9 of the other lever 2. A flat substantially triangular spacer 13 having a thickness corresponding to the spacing between two adjacent strings of a racket is sandwiched between the clamping jaws 6, 7 and pivotally connected to the pin 12 in the central area of the hinge.

A compressed coil spring 14 is inserted between the lever to provide a resiliant means for closing the clamping jaws 6, 7. The ends of the coil springs are caught within two small wells 15, 16 on the inside surfaces 17, 18 of the levers.

The spacer 13 being connected to the pin 12 is free to float or flap freely between the clamping jaws 6, 7 of the levers 2, 3 when the handle sections 19, 20 of the levers 2, 3 are pressed together. Two parallel clamping channels 21, 22 are thus provided respectively on each side of the spacer 13.

Triangular equally spaced notches 23 are cut along the clamping jaws 6, 7 of each lever 2, 3 and of the spacer 13, thus forming a row of teeth corresponding to the spacing of the racket strings. the outside edges of each lever 2, 3 are trapered toward the clamping jaw 6, 7 in order to facilitate insertion of the device between the strings 24 of the racket 25. All the edges in the clamping end 5 and along the spacer are rounded off so as to avoid inadvertant shearing of the racket strings.

In the stringing of a racket, as soon as a string 26 has been tightened, the tension of the next adjacent parallel string 27 can be held by pinching both strings 26, 27 in the two channels 21, 22 between the edges of the levers 6, 7 and the spacer 13. The triangular notches 23 provide clearance for the already strung perpendicular wires 24.

Small variations in the spacing of the mesh between different rackets is easily accommodated by the triangular shape of the teeth and notches along the clamping edges 6, 7 and spacer 13. The thickness of the spacer 13 and the distance between the notches 23 is substantially equal and corresponds to the average spacing of the string in common tennis racket meshes.

It has been found practical to make the clamp lever 2, 3 and spacer 13 out of aluminum in order to reduce its weight. A "hard anodizing" process can then be used to give a slight surface roughness or grain which improves the gripping action over the racket string. The area around the clamping channels 21, 22 can also be mechanically scraped to achieve the same end.

While I have shown and described the preferred form of the present invention, changes and modifications may be made therein within the scope of the appended claims without departing from the spirit and scope of this invention.

What is claimed is:

1. In the stringing of a racket, a clamping device for holding the tension of a string by attaching said string to an adjacent string which comprises:

two levers each having at one end a substantially flat clamping jaw; means for rockingly linking said levers together near said clamping jaws;

resilient means for closing said clamping jaws; and spacer means operatively associated with said linking means so as to be floatingly held between said clamping jaws so that a pair of adjacent parallel strings can be held between said spacer means and respective ones of said clamping jaws.

2. The clamping device claimed in 1 wherein the thickness of said spacer means is substantially equal to the spacing of the strings of the racket.

3. The clamping device claimed in 2 wherein said spacer means and said clamping jaws each have a plurality of notches cut along their clamping edges.

4. The clamping device claimed in 3 wherein said linking means comprises:

a plurality of hollowed projections on the inside surface of said lever; and a pin transversally inserted through said hollowed projections.

5. The clamping device claimed in 4 wherein said spacer means is pivotally connected to said pin.

6. The clamping device claimed in 5 wherein said notches are triangularly shaped and equally spaced.

7. The clamping device claimed in 6 wherein the thickness of said spacer means and the distance between said notches are substantially equal and corresponding to the average spacing of the strings in most common tennis rackets.

8. The clamping device claimed in 7 wherein said resilient means includes a compressed coil spring inserted between said levers.

9. The clamping device claimed in 6 wherein the respective surfaces of said spacer means and said clamping jaws are roughened by hard anodizing process.

* * * * *